United States Patent [19]

Saida

[11] 4,176,979

[45] Dec. 4, 1979

[54] BALL-POINT PEN

[76] Inventor: Yasushi Saida, 20-24, Tsurumaki 5-chome, Setagaya-ku, Tokyo, Japan, 154

[21] Appl. No.: 846,825

[22] Filed: Oct. 31, 1977

[51] Int. Cl.[2] ..... B43K 7/12; B43K 24/04; B43K 21/04

[52] U.S. Cl. ..... 401/100; 401/115

[58] Field of Search ..... 401/100, 115

[56] References Cited

U.S. PATENT DOCUMENTS

| | | | |
|---|---|---|---|
| 2,870,741 | 1/1959 | Kersten | 401/115 |
| 2,978,723 | 4/1961 | Hopkins | 401/100 |

FOREIGN PATENT DOCUMENTS

| | | | |
|---|---|---|---|
| 663362 | 5/1963 | Canada | 401/115 |
| 1761731 | 8/1971 | Fed. Rep. of Germany | 401/100 |
| 1157075 | 12/1957 | France | 401/115 |
| 563807 | 6/1957 | Italy | 401/115 |
| 804596 | 11/1958 | United Kingdom | 401/100 |

*Primary Examiner*—Clyde I. Coughenour

*Attorney, Agent, or Firm*—Burns, Doane, Swecker & Mathis

[57] ABSTRACT

A ball-point pen having simple operating and holding mechanism for ink tube including a ball-point and being capable of retracting and extruding the ball-point with a simple action of turning ball-point tip end of the pen up and down is provided. The ink tube has at its inner end opposite to the ball-point a magnetizable lid and around its body a weight freely slidable between said inner end and a projection provided adjacent the ball-point tip end, while holder tube of the pen has a magnetic member secured adjacent an end facing said lid of the ink tube for magnetically holding said lid and the ink tube when the ball-point is retracted, and a stepped part for locking the lid's end when the ball-point is extruded. When the tip end of the pen is turned down, the weight strikes the projection to separate the lid and hence the ink tube from the magnetic member and, when the tip end is turned up, the weight urges the lid's end to be unlocked from the stepped part.

1 Claim, 7 Drawing Figures

BALL-POINT PEN

This invention relates to ball-point pens and, more particularly, to improvements in ball-point pens of a type capable of retracting and extruding ball-point so as to be used mostly as portable or pocketable.

In this kind of ball-point pens, there have been already suggested various types of operating mechanism for retracting and extruding the ball-point in and out pen holder tube and lock mechanism for holding ink tube having the ball-point in respective retracted and extruded positions in relation to the operating mechanism. The main types are mostly classified as a type wherein the ball-point is retracted and extruded by a rotation of a rotatable part of the pen holder tube about its axis and a type wherein the ball-point is operated by knocking the end part of the holder tube or of the ink tube on the other side of the ball-point. However, in the case of the rotation, it will be necessary to hold the pen holder with both hands in order to rotate the rotatable part and, in the case of knocking, usually the states of the hand in holding the pen holder to knock it and to use it will be different from each other. The number of component parts required for the operating and holding mechanisms is comparatively large and their assembled structure must be complicated. The present invention has been suggested to eliminate these defects of conventional ball-point pens.

A primary object of the present invention is, therefore, to provide a ball-point pen wherein the retracting and extruding operations of the ball point and the mechanisms for operating and locking the ink liquid tube in both of the retracted and extruded positions of the ball-point are very simple.

Another object of the present invention is to provide a ball-point pen wherein the ball-point can be retracted and extruded by a simple operation of turning ball-point tip end of the holder tube up and down.

Other objects and advantages of the present invention will be made clear upon reading the following explanations of the present invention detailed with reference to certain preferred embodiments shown in the accompanying drawings, in which.

Figure 1:
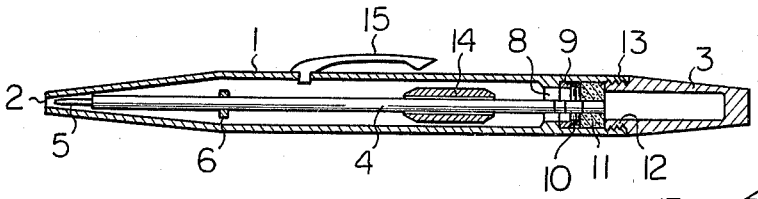
FIG. 1 is a vertically sectioned view of a ball-point pen in an embodiment of the present invention in a state in which the ball-point is retracted.
Figure 2:
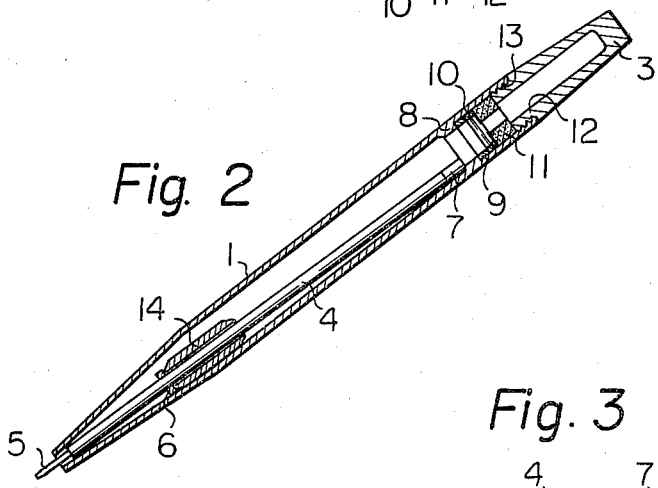
FIG. 2 is a vertically sectioned view of the pen of FIG. 1 as the pen-point is extruded so as to be in a writing state.
Figure 3:
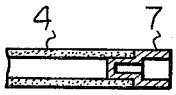
FIG. 3 is a fragmental magnified section showing a magnetic end member of the ink tube of the pen in the embodiment of FIG. 1.

Referring to the first embodiment of the present invention with reference to FIGS. 1 to 3, a cap 3 is screwed to the other end of a holder tube 1 having an opening 2 at the ball-point tip end. A ball-point 5 of an ink tube 4 is made capable of being retracted and extruded in and out of the opening 2. Further, the ink tube 4 has a projection 6 secured near the ball-point end and a lid 7 (see FIG. 3) of a magnetizable material secured at the other end. A stepped part is formed in the holder tube by providing a ring-shaped projection 8 on the inner surface near the other end of the holder tube 1. An annular magnet piece 11 is inserted into the holder tube 1 through a coil spring 10 and a ring 9, the latter of which is brought into contact with the outer side end of the ring-shaped projection 8. A ring-shaped projection 12 of the cap 3 is screw-engaged at 13 to the other end of the holder tube 1 so as to press the spring 10 together with the magnet piece 11 against the projection 8. The lid 7 sensitive material will magnetically adhere to the magnet piece 11 so as to hold the ink tube 4 inside the holder tube 1 with ball-point 5 in its retracted position (FIG. 1). A tubular weight 14 is slidably provided over the ink tube 4. At least the right end in the drawing of the weight 14 is preferably truncate conical. A clip 15 for securing the pen in user's pocket is provided on the holder tube.

In using this ball-point pen which is initially in such state as shown in FIG. 1 of not using wherein the magnetizable lid 7 of the ink tube 4 is magnetically coupled to the magnet piece 11 and the ball-point 5 is held as retracted within the holder tube 1, the pen is to be tilted so as to lower the ball-point tip end, then the weight 14 will slide along the ink tube 4 until the weight strikes the projection 6, whereby the lid 7 is urged to be separated from the magnet piece 11 and, therefore, the ball-point 5 is extruded out of the opening 2 to achieve such a state as shown in FIG. 2. If the pen is tilted slowly gently, on the other hand, the weight 14 will slowly slide but only stops when it engages the projection 6 so that the lid 7 will continue to be magnetically coupled to the magnet piece 11 and the ball-point 5 will be kept retracted.

In the state of FIG. 2, the lid 7 of the ink tube 4 separated from the magnet piece 11 shifts over the ring-shaped projection 8 and falls into engagement at its end surface with the inner edge of the pojection 8 as off-centered to be thereby locked against a pressure applied to the ball-point 5 during the use so that the ball-point 5 will be kept extruded since the pen is usually kept in tilted state during the use.

When the ball-point 5 is to be retracted, the pen is erected so as to dispose the ball-point tip end upward from the state of FIG. 2. Then the weight 14 will quickly lower along the ink tube 4 also along the inner wall of the holder tube 1 so as to urge the end on the side of the lid 7 of the ink tube 4 to be shifted toward the center of the holder tube, whereby the lid 7 is disengaged from the projection 8 and passes through the projection 8 and coil spring 10 so as to be magnetically coupled to the magnet piece 11 and the ball-point 5 will be retracted and kept in the state of FIG. 1.

Figure 4:
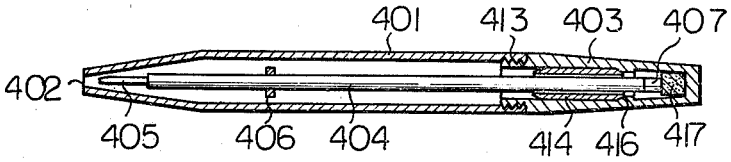
FIG. 4 is a vertically sectioned view of another embodiment as the ball-point is retracted.
Figure 5:
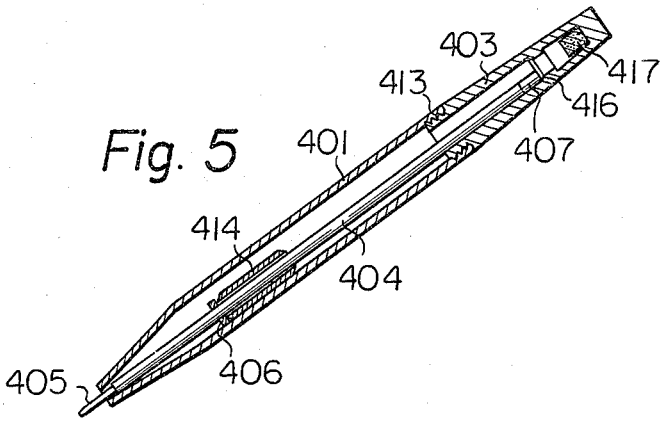
FIG. 5 is a vertically sectioned view of the embodiment of FIG. 4 in its writing state.

Another embodiment of the present invention shall be explained with reference to FIGS. 4 and 5. Pen holder tube 401 is made shorter than the holder tube in the case of FIG. 1, a ring-shaped projection 416 is provided within holder cap 403 and a columner magnet piece 417 is provided in the inner bottom part of the cap 403. The operation of this embodiment is the same as in the case of FIG. 1.

In both embodiments, the distance between the lock-engagement part of the ring-shaped projection and the inner surface of the magnet piece should be of a length required for achieving the retracting and extruding operation of the ball-point.

Figure 6:
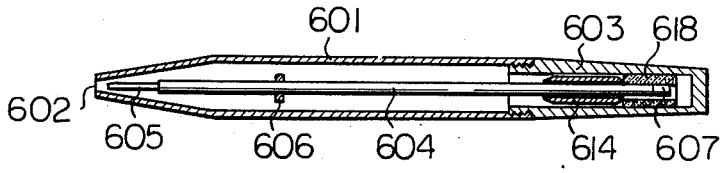
FIG. 6 is a vertically sectioned view of still another embodiment as the ball-point is retracted.
Figure 7:
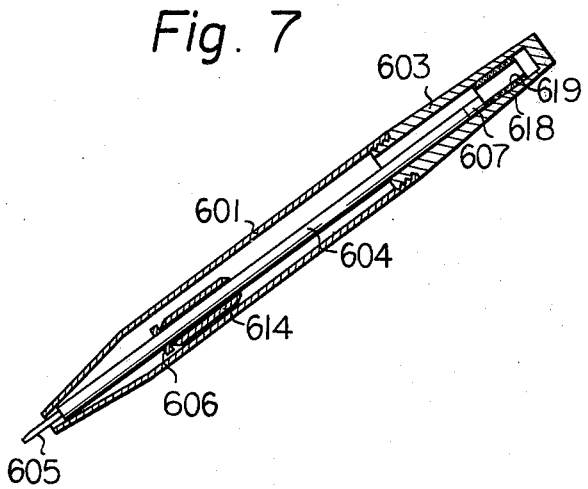
FIG. 7 is a vertically sectioned view of the embodiment of FIG. 6 in its writing state.

In still another embodiment of the present invention as shown in FIGS. 6 and 7, in which the projection 8 or 16 in the foregoing embodiments is omitted, whereas an axially holed magnet piece 618 is secured in holder cap 603 so that the inner end of the ink tube 604 having a magnetizable lid 607 will come into and out of an axial hole 619 of the magnet piece 618. As required, in order to protect the magnet piece, a projection may be provided on the inner side of the magnet piece within the cap.

As in the above, in the present invention, by changing the direction of the ball-point pen, the ink tube is moved with the movement of the weight so that the ball-point is urged to be retracted and extruded. Therefore, the ball-point pen according to the present invention is simple to handle and easy to assemble.

What is claimed is:

1. A ball-point pen comprising an ink tube having a ball-point at one end, a lid of a magnetizable material at the other end and a projection intermediate said ends, an outer case for housing therein said ink tube and comprising a holder part and a cap part, a weight slidably mounted on the outer surface of the ink tube, a tubular magnet carried by said outer case and defining at an end thereof nearest the ball-point a generally radial step for engaging said lid of the ink tube when said ball-point is extended out of an opening of the holder part to exert mechanical and magnetic locking forces on said lid to hold said ball-point in the extended position, said tubular magnet receiving said lid therein when said ball-point is retracted inside the holder for magnetically attracting and holding said lid to retain the ball-point in the retracted position, said weight being slidable toward said lid when the pen is inverted to release said lid from engagement with said step.

* * * * *